United States Patent [19]

Feldkämper et al.

[11] Patent Number: 4,542,894

[45] Date of Patent: Sep. 24, 1985

[54] ROTARY APPLICATOR HAVING SUCTION ROLLERS WITH SUCKERS WHICH CAN BE SWITCHED OFF

[75] Inventors: Richard Feldkämper; Siegfried Maneke, both of Lengerich; Bernhard Philipp, Ibbenbüren, all of Fed. Rep. of Germany

[73] Assignee: Windmoller & Holscher, Lengerich, Fed. Rep. of Germany

[21] Appl. No.: 470,962

[22] Filed: Mar. 1, 1983

[30] Foreign Application Priority Data

Mar. 9, 1982 [DE] Fed. Rep. of Germany ..... 3208425

[51] Int. Cl.[4] ..... B65H 5/08; B65H 3/12

[52] U.S. Cl. ..... 271/11; 271/91; 271/95

[58] Field of Search ..... 271/11, 91, 93, 95

[56] References Cited

U.S. PATENT DOCUMENTS 3,251,879 7/1970 Niemeyer ..... 271/27
3,599,970 8/1971 Smithe ..... 271/95

FOREIGN PATENT DOCUMENTS 687749 5/1940 Fed. Rep. of Germany .
3208425 5/1984 Fed. Rep. of Germany .

*Primary Examiner*—Richard A. Schacher
*Attorney, Agent, or Firm*—Fleit, Jacobson, Cohn & Price

[57] ABSTRACT

In a rotary applicator, suction rollers planetating about a central shaft are provided with suckers which are arranged in a row, project beyond the enveloping cylinders of the rollers and are placed on sucker carriers having suction air bores. The carriers communicate with suction air conduits and are rotatably but axially undisplaceably placed by means of sleeve-like tube members on the suction air conduits, the latter consisting of supporting tubes. The walls of the tubes and tube members are provided with bores which are in registry in the operative position of the suckers and of which the bores of the tube members communicate with the suction air bore of the sucker carrier. The suckers are rotatable to a position in which they are swung back within the enveloping cylinder and the walls of the tube members cover the bores of the supporting tube.

9 Claims, 16 Drawing Figures

ROTARY APPLICATOR HAVING SUCTION ROLLERS WITH SUCKERS WHICH CAN BE SWITCHED OFF

The invention relates to a rotary applicator having suction rollers which are provided with suckers arranged in a row and which planetate about a central shaft, wherein the suckers project beyond the enveloping cylinders of the rollers and are placed on sucker carriers which are provided with suction air bores and communicate with suction air conduits.

In rotary applicators of this kind known for example from DE-AS No. 12 77 655, it is conventional when separating stacked tube members which are narrower than the row of suckers to use adhesive strips to cover those suckers which are not covered by the tube members withdrawn thereby, the intention being to prevent the entry of false air into the suction air system.

It is the problem of the present invention to provide a rotary applicator of the aforementioned kind, wherein the suckers are provided with means for turning them off that could also be actuated automatically.

According to the invention, this problem is solved in that the sucker carriers are rotatably and axially undisplaçeably placed by means for sleeve-like tube members on the suction air conduits consisting of supporting tubes and the walls of the tubes and tube members are provided with bores which are in registry in the operative position of the suckers and as a result of which the bores of the tube members communicate with the suction air bores of the sucker carriers, and that the suckers are rotatable to a position in which they are swung back within the enveloping cylinder and the walls of the tube members sealingly cover the bores of the supporting tubes.

According to another suggestion for solving the problem stated above, the invention provides that the sucker carriers are so guided and insertable in transverse bores of carriers that communicate with the suction air conduits, that their suction air bores are closed by seals disposed in the bores, or the sucker carriers close the suction air conduits in a sliding manner.

To define the operative positions and rest positions of the sucker carriers positively, snap or locking means may be provided which offer a greater resistance to movement of the sucker carriers.

For automatically turning the suckers on and off, means by be provided in the machine frame which are operable by way of piston-cylinder units or stepping motors and which sequentially engage the suckers turned into the adjusting positions.

Advantageous embodiments of the invention are described herein.

Examples of the invention will now be described in more detail with reference to the drawing, wherein.

Figure 1:
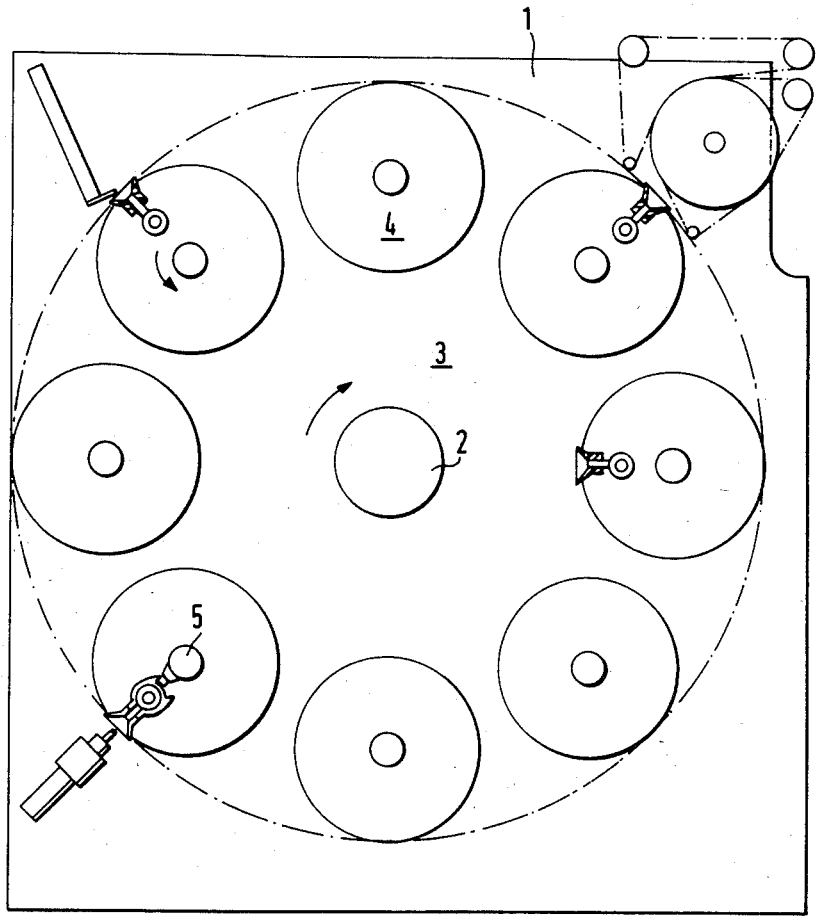
FIG. 1 is a diagrammatic end elevation of the rotary applicator.
Figure 2:
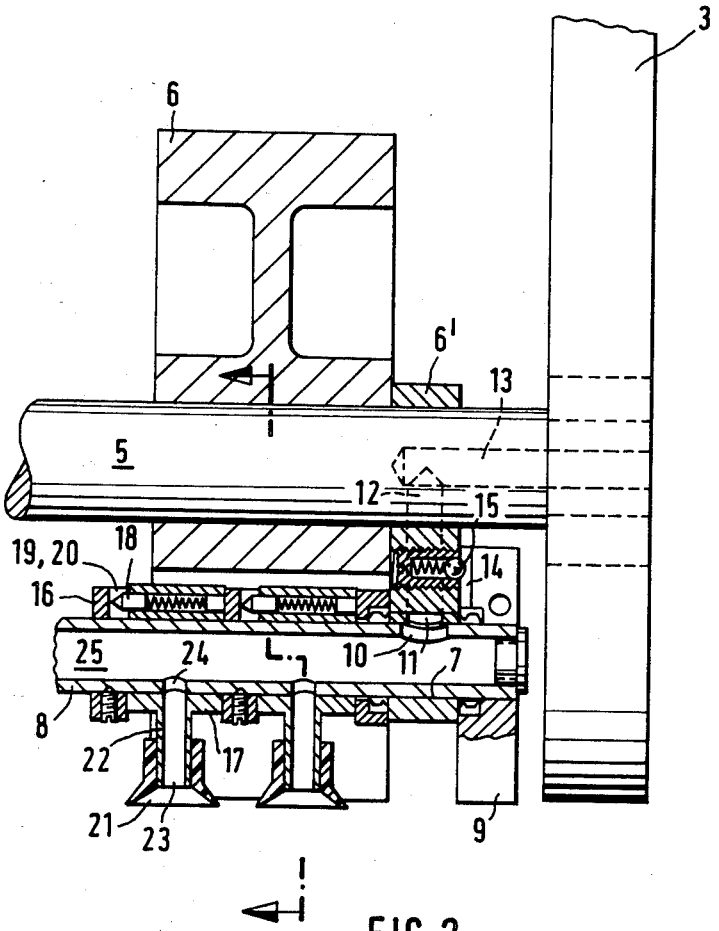
FIG. 2 is a part-section through one of the suction rollers of the rotary applicator according to FIG. 1.

In the example of a rotary applicator according to FIGS. 1 to 5 and 16, the machine frame has a side wall 1 in which the shaft 2 is rotatably mounted. The shaft carries two spaced supporting plates 3. Between these two supporting plates 3 there are eight suction rollers 4 each consisting of a roller shaft 5 and a plurality of spaced roller discs 6 thereon. As is shown in FIG. 2, a lever 6' clamped onto the roller shaft 5 has a receiving bore 7 for receiving a hollow supporting bar 8. This hollow supporting bar 8 is rotatably mounted in the bore 7 by way of an adjusting lever 9 and includes a bore 10 which, in the basic position of FIG. 2, is in registry with a passage 11 in the lever 6'. The passage 11 communicates with a radial blind hole 12 in the roller shaft 5. The blind hole in turn communicates with a further axial blind hole 13 that is provided in the roller shaft 5, extends outwardly through the supporting plate 3 and has a vacuum conduit (not shown) connected to it.

The basic position shown in FIG. 2 is positively defined in that the adjusting lever 9 includes a groove 14 in which there engages a spring-loaded ball 15 which is displaceably mounted in the lever 6' against a spring force. A plurality of setting rings 16 is screw-connected to the hollow supporting bar 8. Between the setting rings, sucker carrier members 17 are rotatably mounted on the supporting bar 8. Each sucker carrier member 17 has a resilient locking cylinder 18 which engages in one of two notches 19, 20 depending on the rotary position of the sucker carrier members 17. The actual suction grippers 21 of rubber-like material are pushed onto studs 22 of the sucker carrier members 17, the studs 22 having a passage 23 which, in the basic position of FIG. 2, communicate by way of bores 24 with the central bore 25 of the hollow supporting bar 8.

As is shown in FIGS. 3 to 5 and 16, each sucker carrier member 17 carries two spaced abutments 26 and 27 of which one comes to lie against a supporting member 28, of which several are placed on the roller shaft 5, namely a number corresponding to the number of sucker carrier members 1. The position of the suction grippers 21 shown in FIG. 2 corresponds to that shown in FIG. 5.

Figure 3:
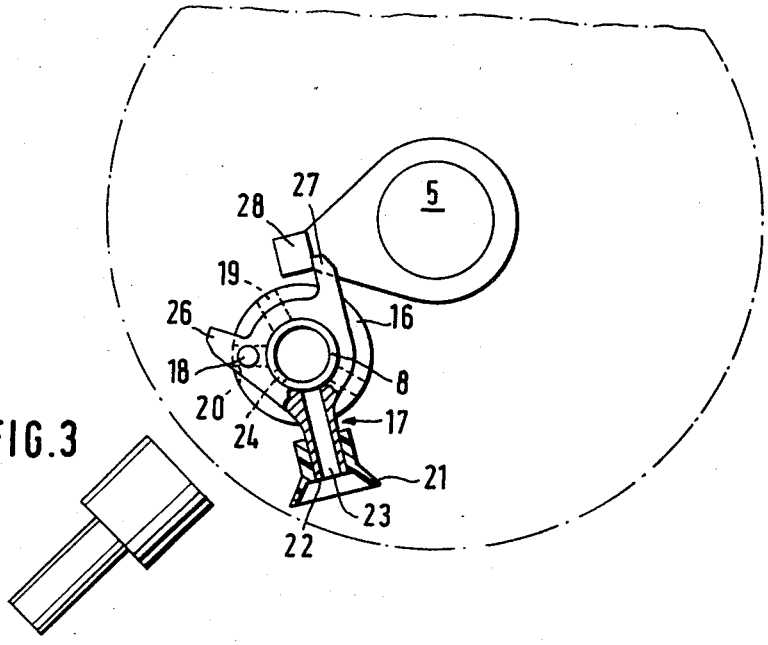
FIGS. 3 to 5 are sections through the FIG. 2 suction roller with suckers swung to different positions.
Figure 4:
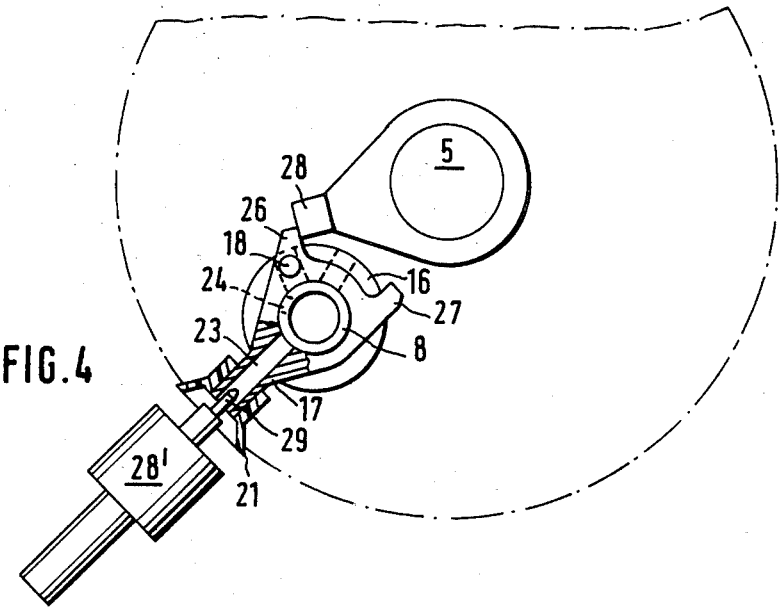
Figure 5:
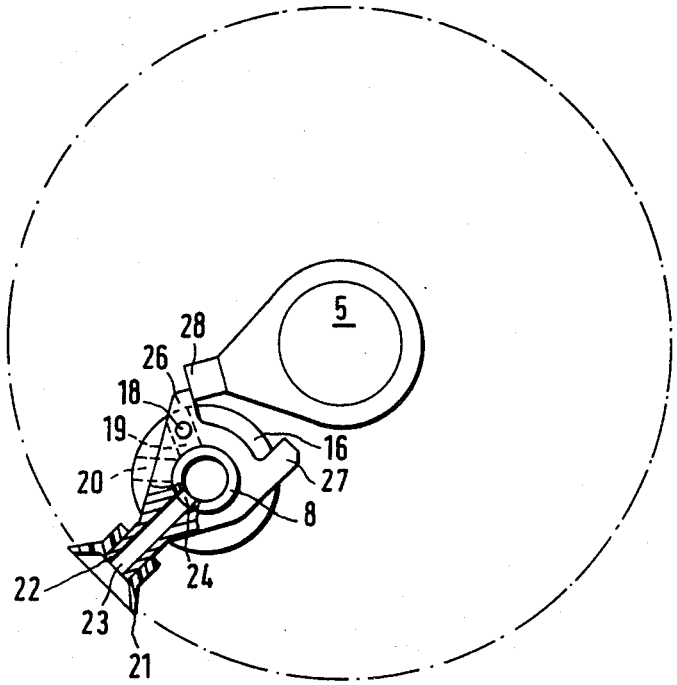

To explain the adjustment, it will now be assumed that the suction gripper 21, shown swung away in FIG. 3, has to be swung into a position necessary for engaging a workpiece. The position shown in FIG. 3 will be explained first. It will be seen that the sucker carrier member 17 is turned relative to the supporting bar 8 to such an extent that the bore 23 of the stud 22 does not correspond to the bore 24 of the hollow supporting bar 8, so that the sucker carrier member 17 cannot be subjected to vacuum. In this position, the resilient locking cylinder 18 is engaged in the notch 20 of the setting ring 16 and the abutment 27 lies against the abutment member 28 of the roller shaft 5. The supporting bar 8 is turned 60° clockwise out of this position by way of the adjusting lever 9. By reason of the fact that the locking cylinder lies in the notch 20, the sucker carrier member 17 is likewise turned through 60°, i.e., brought to the operative position (see FIG. 4). As soon as the sucker carrier member 17 has been brought to the operative position, the cylinder 28' lying opposite each sucker moves out so that the piston rod 29 projects into the bore 23 of the sucker carrier member 17. Thereafter, the hollow supporting bar 8 is again turned anti-clockwise through 60° by way of the adjusting lever 9. By means of this rotary motion (FIG. 4), the hollow supporting bar 8 has therefore been turned back through 60° so that the bore 24 of the supporting bar 8 now corresponds to the bore 23 of the sucker carrier member 17. The locking cylinder 18 has thereby snapped into the notch 19. The cylinder 28' then returns to its basic position and the operating process of the rotary applicator can now commence with the sucker carrier member 17 brought to the operative position. Swinging a sucker carrier member 17 out of the operative position into the rest position shown in FIG. 3 takes place in an analogous manner.

Figure 6:
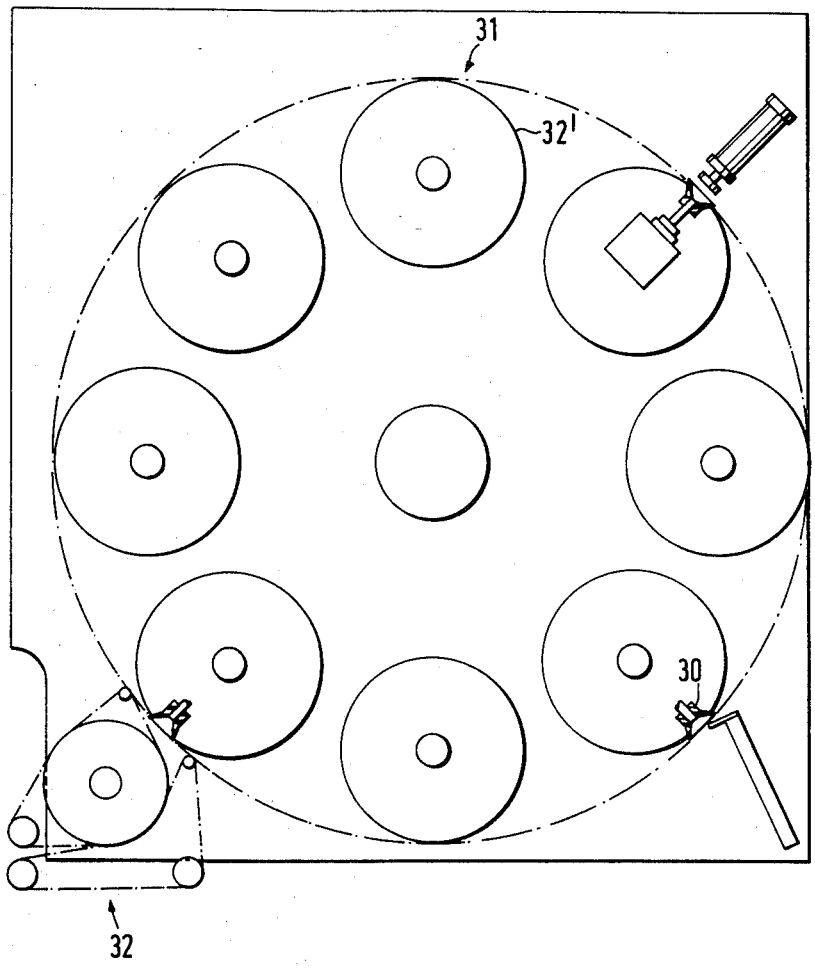
FIG. 6 is a diagrammatic end elevation of a different embodiment of rotary applicator.
Figure 7:
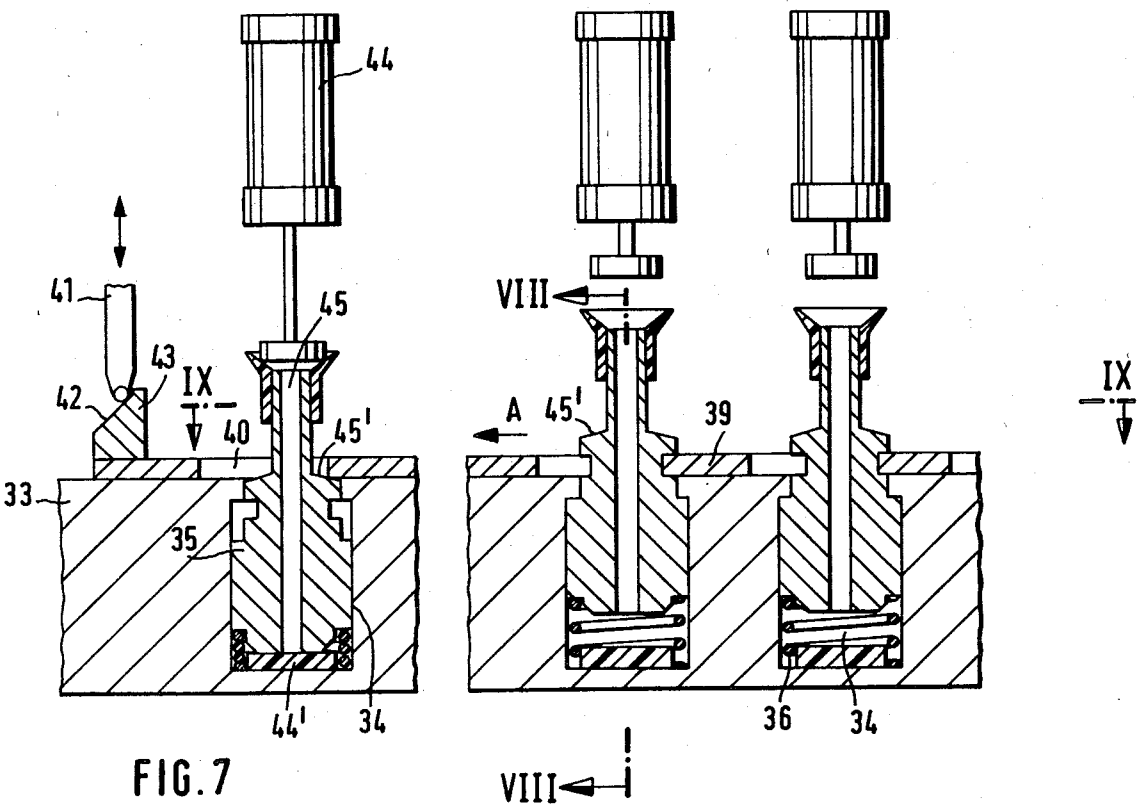
FIG. 7 is a part-section through a row of suckers of one of the suction rollers of the FIG. 6 rotary applicator.
Figure 8:
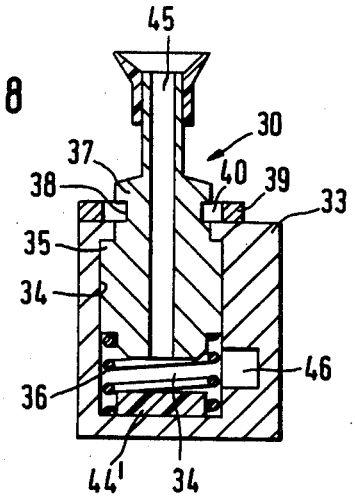
FIG. 8 is a section through a sucker on the line VIII—VIII in FIG. 7.
Figure 9:
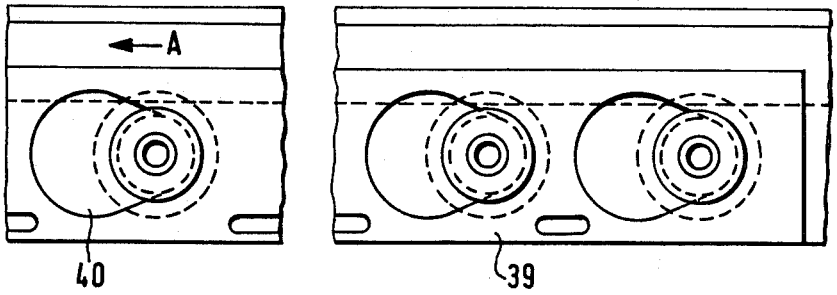
FIG. 9 is a section through the suckers on the line IX—IX in FIG. 7.

FIGS. 6 to 9 show a different solution, FIG. 8 being a section on the line VIII—VIII in FIG. 7. FIG. 9 is a view on the lines IX—IX in FIG. 7. FIG. 6 is a fundamental drawing showing that the individual suction grippers 30 lead individual tube sections from the separating station 31 to the delivery station 32, the individual suction grippers 30 being combined to form a total of eight suction stations 31. In turn, each suction station consists of individual rollers 32 and profiles 33 which are passed through recesses in the rollers 32 and which bridge spaces between the rollers 32. Each profile 33 has spaced bores 34 in which the respective piston portion 35 of a suction gripper 30 is displaceably guided against the force of a spring 36. Each piston portion 35 has a collar 37 so that an annular groove 38 is formed between the piston portion 35 and the collar 37.

As seen from FIG. 9, each profile is associated with a locking plate 39 comprising a plurality of juxtaposed diverging openings 40. In the FIGS. 7 and 8 position, this locking plate 39 is displaced in the direction of the arrow A by means of a spring (not shown) so that the edges of the openings 40, namely at the place where the sides converge, have been received in the annular grooves 38, so that the individual piston portions 35 are locked in position. If, now, a suction gripper 30 is to be switched off, the annular plate is pushed to the right by way of the tappet 41 which runs onto the inclined face 42 of an extension member 43 of the annular plate 39, so that the individual piston portions can be displaced against the force of the spring 36. This only occurs in the case of the suction grippers which are no longer required. These suction grippers are inserted in the bore 34 by their associated piston-cylinder unit 44 against the force of the spring 36 until the seal 44' is disposed in front of the suction bore 45 and closes the innermost end thereof.

Of course the opening 40 has a diameter at its largest region so that the collar 37 of the suction gripper 30 to be moved away can be pressed downwardly through the opening 40. Thereafter, the tappet 41 is moved upwardly so that the locking plate can return to its FIGS. 7 and 9 position under the force of a spring (not shown). The suction gripper shown at the left-hand side of FIG. 7 has been illustrated in the moved-away position. It will be evident from this that the locking plate 39 has been pushed onto the inclined ramp 45' of the collar 37 so that the piston portion 35 and the suction bore 45 are constantly pushed against the seal 44'. It might be mentioned that all the bores 34 communicate with a central suction air bore 46.

Figure 10:
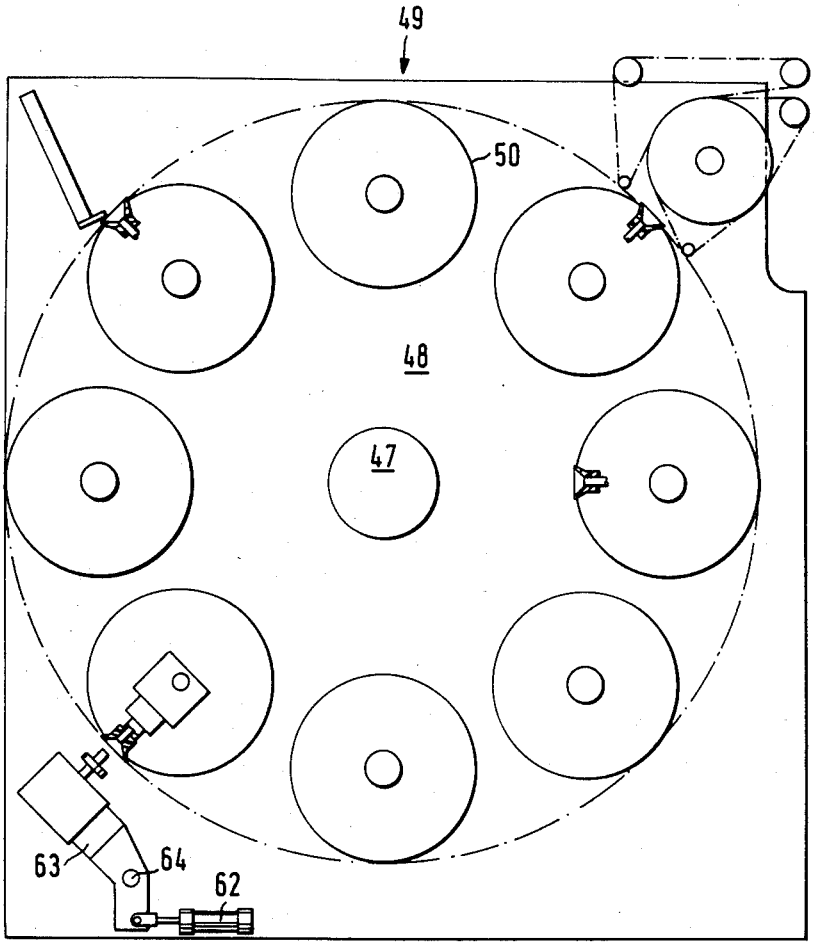
FIG. 10 is a diagrammatic end elevation of a third embodiment of a rotary applicator.
Figure 11:
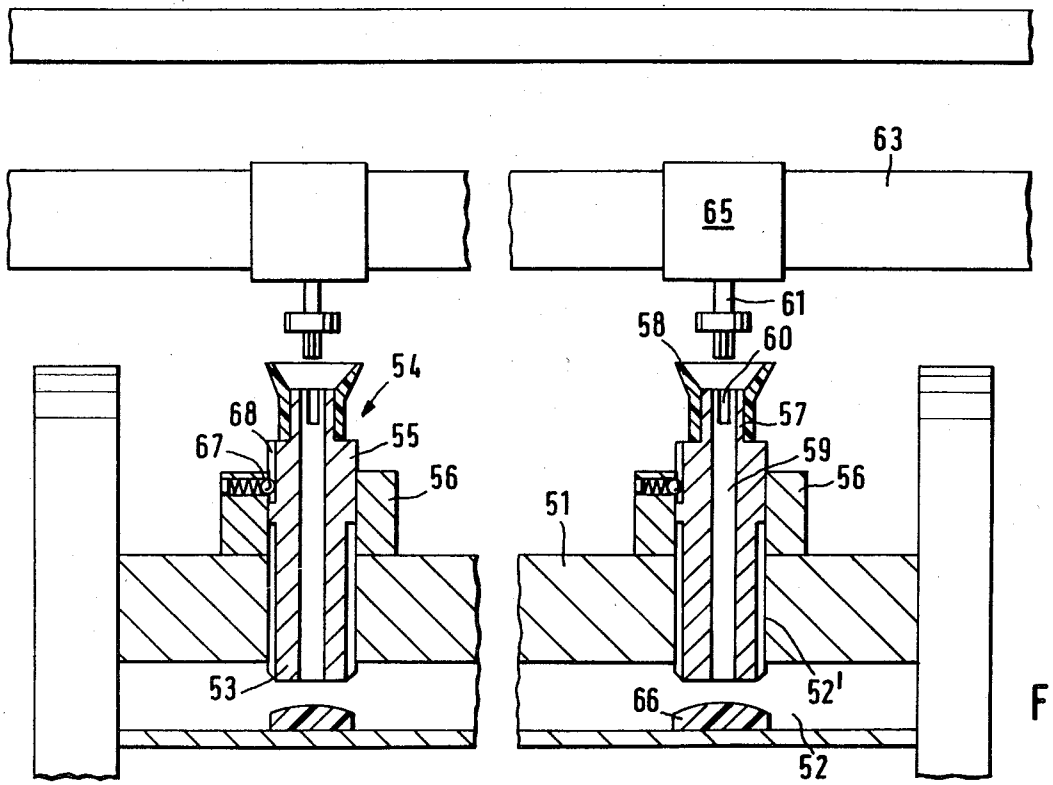
FIG. 11 is a section through a row of suckers of one of the suction rollers of the FIG. 10 rotary applicator.

FIGS. 10 and 11 show another solution. FIG. 10 again illustrates the basic construction of a rotary applicator comprising the shaft 47, the supporting plate 48 and the suction stations 49. Here, again, the individual suction stations consist of rollers 50 having recesses through which there are passed cross-members 51 which are rotatably mounted at both ends in the supporting plates 48. The cross-members 51 each have a transverse bore 52 in constant communication with a vacuum conduit in a manner not shown.

As will be evident form FIG. 11, the cross-member 51 comprises a plurality of spaced bores 52' having a screwthread. The screwthreaded portion 53 of a suction gripper 54 is engaged in each screwthread, the suction gripper having, in addition to the screwthreaded portion 53, a guide portion 55 which is sealingly guided for axial movement in a plummer block 56. The sucker 58 proper is pushed onto the reduced portion 57 of each suction gripper 54, a bore 59 extending from the sucker 58 to the transverse bore 52 in the cross-member 51. A slot 60 is provided adjacent the bore 59 in the free end of the guide member 57.

To bring one or more suction grippers 54 to an inoperative position, the piston-cylinder unit 62 (FIG. 10) swings the swing arm 63 about the shaft 64 in such a way that the spindles 61 of the stepping motors 65 engage in the slots 60 of the suction grippers 54 with their free screwdriver-like ends. The stepping motors 65 associated with the suction grippers 54 to be moved away are then switched on whereby the appropriate suction grippers 54 can be turned so far into the cross-member 51 until their bore 59 is closed by the seal 66. Thereafter, the swing arm 63 returns to its basic position by actuating the piston-cylinder unit 62. To ensure that the suction grippers 54 remain in their set position, spring-loaded locking balls 67 are provided which engage in longitudinal grooves 68 of the suction grippers 54.

Figure 12:
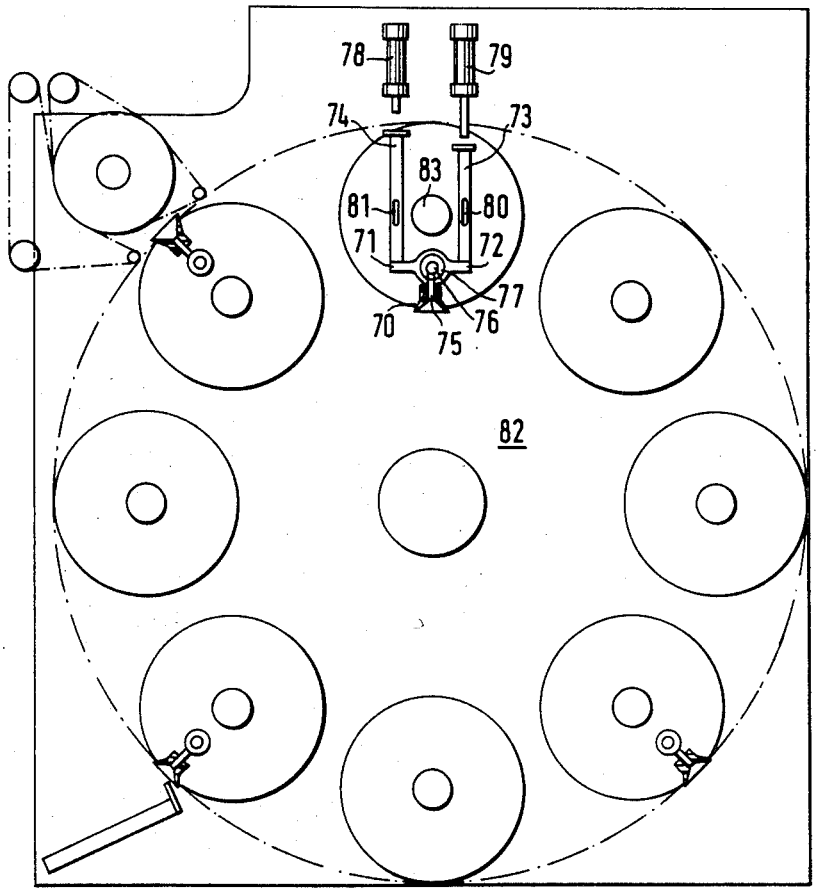
FIG. 12 is a diagrammatic end elevation of a fourth embodiment of a rotary applicator.

Another possible way of adjusting the suction grippers 70 is shown in FIG. 12. In this case, all the suction grippers 70 have arms 71 and 72 which can be turned into and out of the operative position by way of tappets 73 and 74. In the illustrated position, the bore 75 of suction gripper 70 corresponds to the bore 76 of the supporting tube 77, i.e. the suction gripper 70 is in operation.

If, now, the tappet 74 is actuated by way of the hydraulic piston-cylinder unit 78, the arm 71 is swung anti-clockwise whereby the bore 75 of suction gripper 70 is turned past the bore 76 of the supporting tube 77, which is stationary in relation to the movable suction gripper 70. During this adjustment, the piston rod of piston-cylinder unit 79 is pushed back by way of the tappet 73. During this phase of the motion, the piston-cylinder unit 79 is without pressure. Tappets 73 and 74 have longitudinal holes 80 and 81 by way of which they are connected to the supporting plate 82 in a manner not shown, as are the roller shafts 83.

Figure 13:
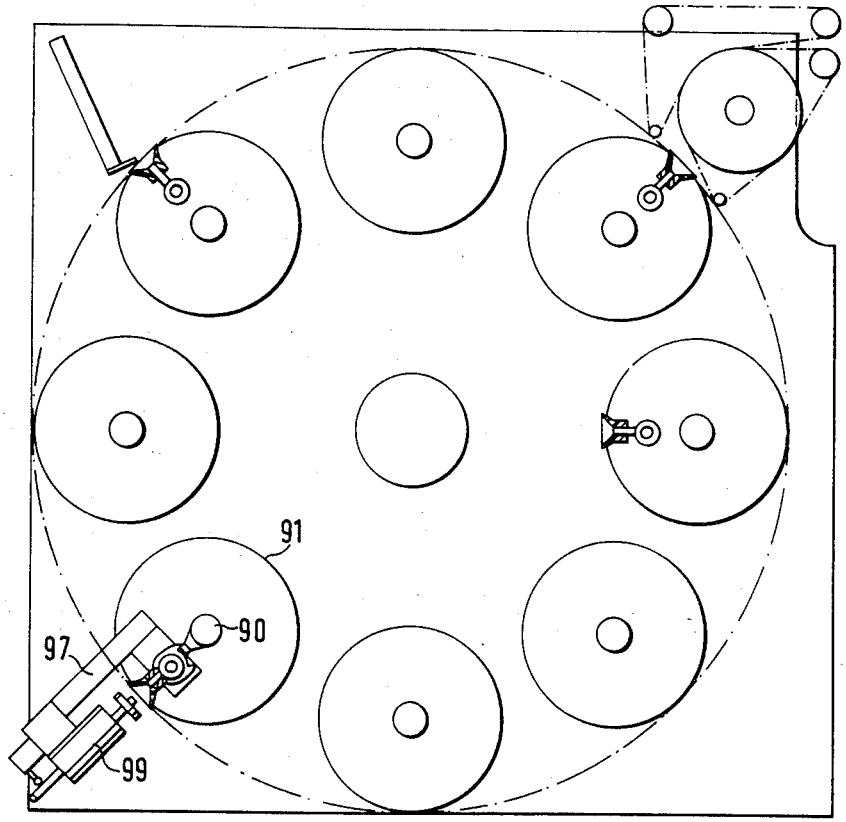
FIG. 13 is a diagrammatic end elevation of a fifth embodiment of a rotary applicator.
Figure 14:
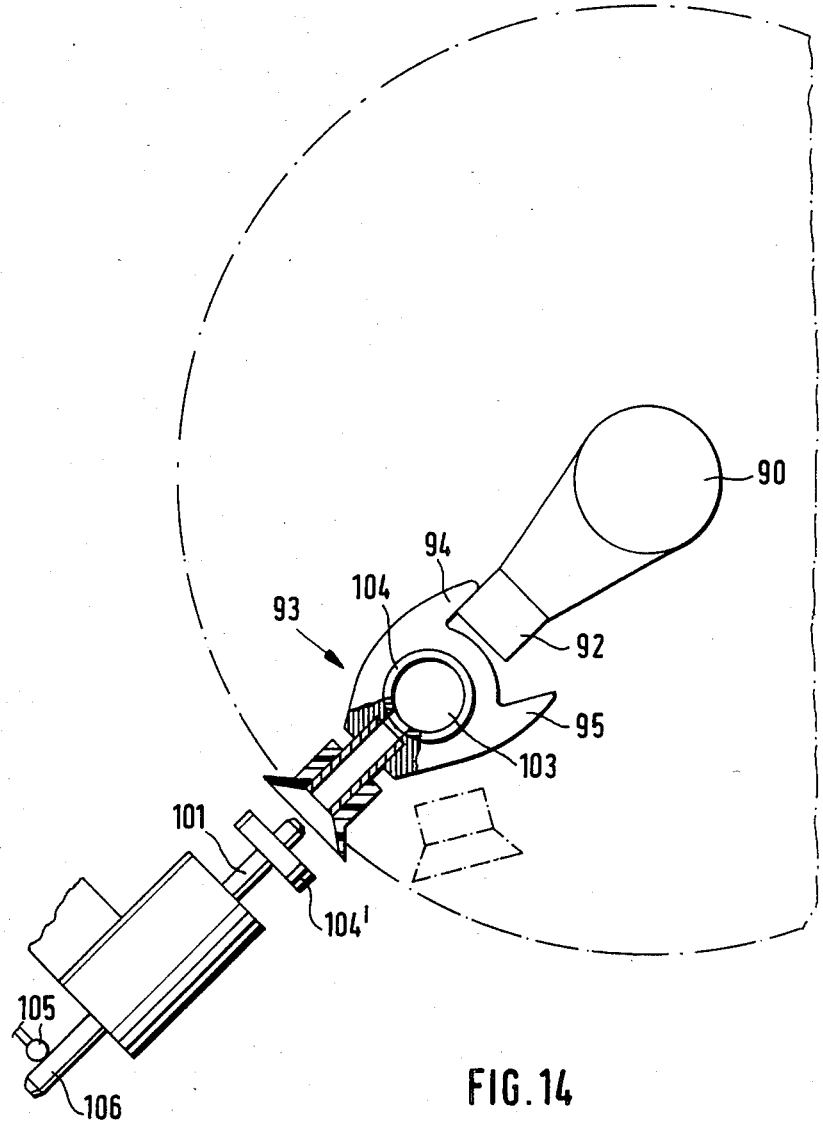
FIG. 14 is a section through a sucker of a suction roller of the rotary applicator according to FIG. 13.
Figure 15:
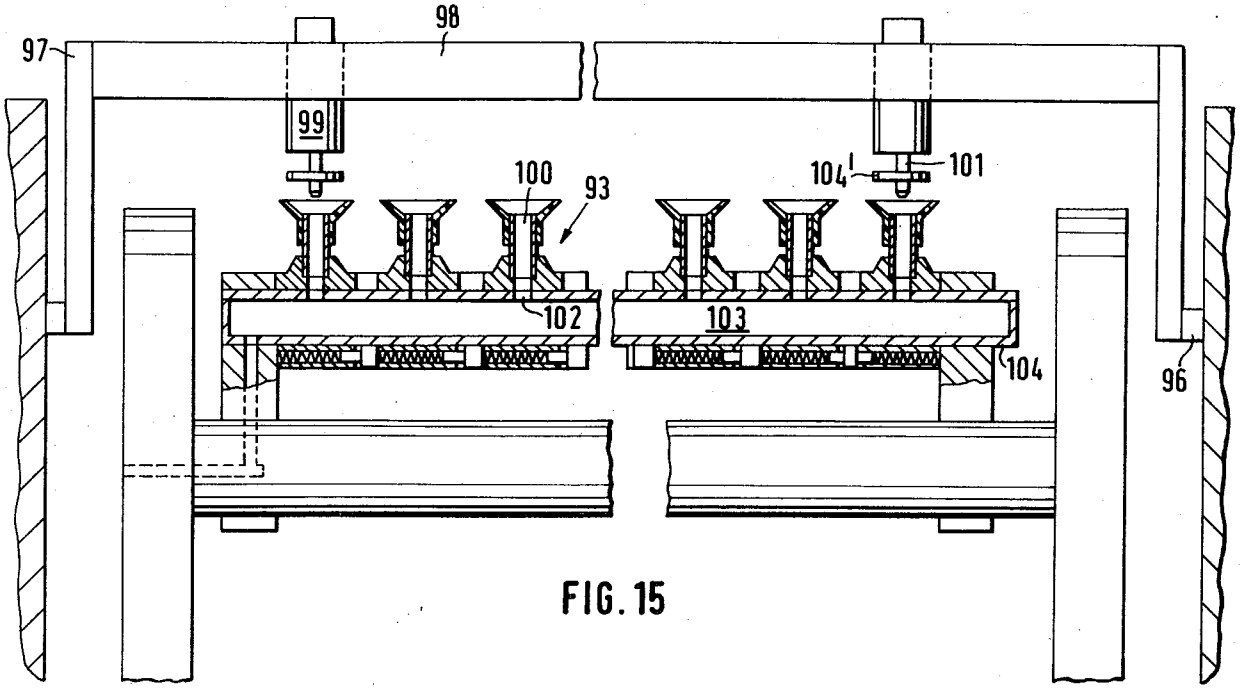
FIG. 15 is a longitudinal section through a suction roller of the FIG. 13 applicator.
Figure 16:
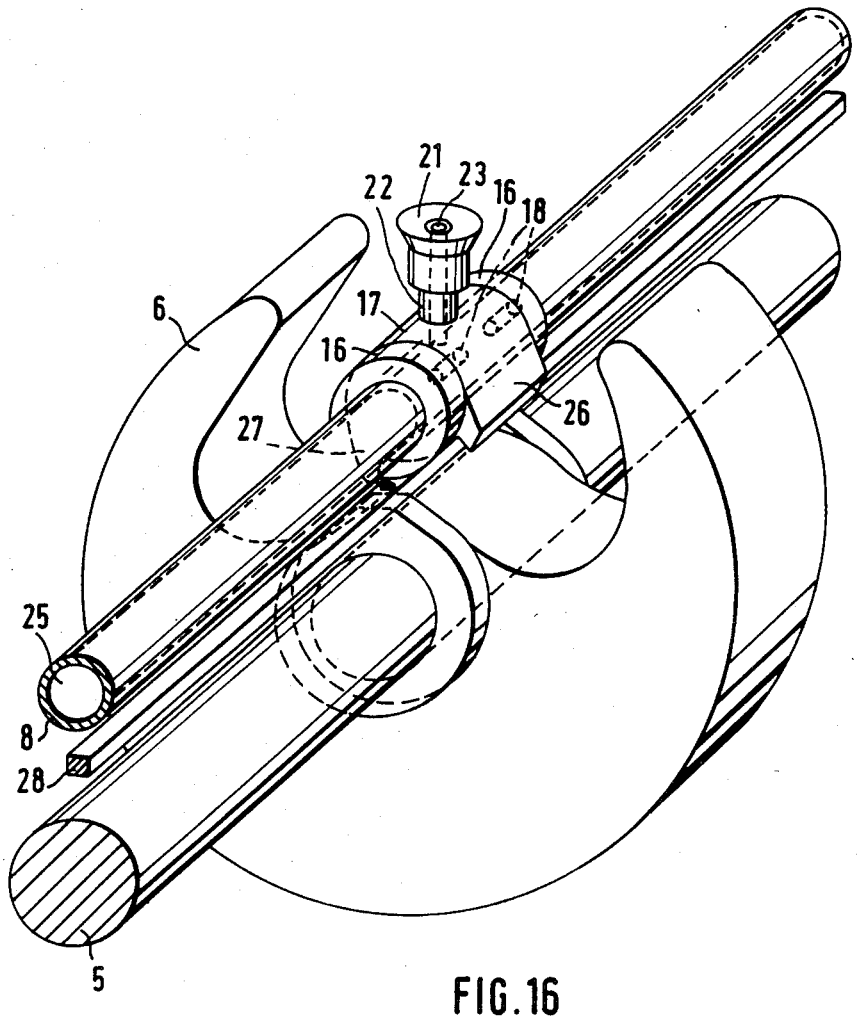
FIG. 16 is a perspective view of a roller disc according to FIGS. 3 to 5.

In the FIGS. 13 to 15 example, the roller shaft 90 carries, adjacent to the actual rollers 91, a plurality of cam members 92 corresponding in number to that of the suction grippers 93. These suction grippers 93 include cams 94 and 95, each cam 94 or 95 coming to lie against the cam member 92. To move individual suction grippers 93 out of the full line position in FIG. 14 to that shown in broken lines, a frame 97 pivotable about the shaft 96 has an arm 98 extending parallel to the roller shaft 90 and carrying piston-cylinder units 99 of a number corresponding to that of the suction grippers 93. The piston rods 101 of the hydraulic piston-cylinder units 99 are then moved into the bores of those suction grippers 93 which are to be moved away. The entire frame 97 is then swung about the shaft 96, the corresponding suction grippers 93 being pivoted by the projected piston rods 101 in a manner such that their bores 100 no longer communicate with the bores 102 or the central bore 103 of the supporting bar 104. Thereafter, the piston rods 101 as well as the frame 97 return to their basic positions.

Now, in order to return the swung-away suction grippers shown in broken lines in FIG. 14 to the operative position, it is necessary for the frame 97 to be swung out of its FIG. 13 position and then to extend the piston rods of all the piston-cylinder units 99. Those piston rods which find no suction gripper 93 while moving out are then retracted again. Projection of the pistons is limited by a pressure plate 104', namely when this pressure plate 104' lies against a suction gripper 93. If this pressure plate 104' encounters no resistance, the piston rod is extended further until the extension 106 of the piston rod 101 releases the switch 105. Release of this switch 105 means that the piston rod has to be returned again because it has not found any suction gripper being swung back. After this has occurred, the frame 97 is swung back to the FIG. 13 position by means (not shown) so that all the scanned suction grippers 93 have been returned to the operative position.

We claim:

1. A rotary applicator for carrying articles along a circular arc, said applicator comprising:

(a) A rotatable frame;

(b) a plurality of suction supports rotatably carried in said frame, said suction supports having their axes in substantially parallel relationship and spaced from each other along a circle concentric with the axis of rotation of said frame;

(c) a plurality of aligned suction grippers carried by said suction supports, said suction grippers each including a gripping head for engagement with an article to be carried, each gripping head having a suction aperture that opens outwardly toward the article to be carried;

(d) means for providing communication between said suction apertures and a suction air conduit, said communication means including a tubular supporting member carried by each of said suction supports and having first apertures, said suction grippers mounted on carrier members rotatably carried on said supporting members and having second apertures that communicate with said suction apertures, said carrier members being pivotable relative to said supporting members to selectively bring said first and second apertures into and out of alignment with each other; and (e) means for selectively shifting said suction grippers from an operative position in which the respective gripping heads extend beyond the surface of an enveloping cylinder that envelopes said suction supports in order to contact an article to be carried, to an inoperative position in which the respective gripping heads are within the enveloping cylinder in order to preclude contact with an article to be carried, said first apertures being in alignment with corresponding second apertures when said suction grippers are in the operative position to provide communication between said suction apertures and a suction air conduit, and said first apertures being out of alignment with corresponding second apertures when said suction grippers are in the inoperative position to prevent communication between said suction apertures and a suction air conduit.

2. A rotary applicator according to claim 1 wherein the carrier members include spring-loaded locking means engageable with locking recesses connected to the supporting members to selectively retain the carrier members alternately in the operative position and in the inoperative position.

3. A rotary applicator according to claim 1 wherein the supporting member is axially undisplaceably mounted in the suction support and is rotatable between the operative position and the inoperative position by means of a lever connected to the supporting member.

4. A rotary applicator according to claim 3, wherein the lever for rotating the supporting member incudes connection means for locking the lever to the suction support in the operative position of the suction grippers.

5. A rotary applicator according to claim 1 wherein the carrier members include abutment means arranged in a fork shape defined by two spaced legs, and an arm positioned between the spaced legs and carried on the suction support, one leg of which contacts the arm when the suction grippers are in the operative position and the other leg of which contacts the arm when the suction grippers are in the inoperative position.

6. A rotary applicator according to claim 1, including extensible pins movable into and in registry with the suction apertures to hold the suction grippers to permit the supporting members to be rotated relative to the suction grippers.

7. A rotary applicator according to claim 1 including a frame that projects over the suction supports and is pivotably mounted relative thereto, said frame carrying pins which are movable into and out of the suction apertures when the suction grippers are in the operative position, said frame carried on a pivotal shaft substantially coaxial with the axes of rotation of the suction supports.

8. A rotary applicator according to claim 7, wherein the pins include a pressure plate to limit inward movement into the suction apertures and are engageable with a limit switch to sense excessive inward movement of the pins in the absence of a suction gripper to cause retraction of the pins.

9. A rotary applicator according to claim 1 wherein the carrier members are pivotable by tappets mounted in the suction supports and which can be actuated by the piston rods of piston-cylinder units secured in a fixed frame that supports the rotatable frame.

* * * * *